US006554556B2

(12) United States Patent
Erfgen et al.

(10) Patent No.: US 6,554,556 B2
(45) Date of Patent: Apr. 29, 2003

(54) METHOD FOR THE MANUFACTURE OF A RING PART OUT OF SHEET METAL FOR A LID OF A CAN

(75) Inventors: Werner Erfgen, Melsbach (DE); Reiner Sauer, Heimbach-Weis (DE)

(73) Assignee: Rasselstein Hoesch GmbH, Andernach (DE)

( * ) Notice: Subject to any disclaimer, the term of this patent is extended or adjusted under 35 U.S.C. 154(b) by 12 days.

(21) Appl. No.: 09/846,167

(22) Filed: May 1, 2001

(65) Prior Publication Data

US 2001/0041115 A1 Nov. 15, 2001

(30) Foreign Application Priority Data

May 10, 2000 (DE) ..... 100 22 553

(51) Int. Cl.[7] ..... B21D 51/40; B21D 51/44

(52) U.S. Cl. ..... 413/1; 72/702; 413/3; 413/6

(58) Field of Search ..... 413/1, 3, 8, 13, 413/14, 6, 69; 72/306, 369, 702; 220/273

(56) References Cited

U.S. PATENT DOCUMENTS 3,669,346 A * 6/1972 Leezer et al.
3,871,314 A * 3/1975 Stargell ..... 413/3
4,052,949 A * 10/1977 Woodley ..... 413/3

FOREIGN PATENT DOCUMENTS

DE 43 32 306 3/1995

* cited by examiner

*Primary Examiner*—W. Donald Bray
(74) *Attorney, Agent, or Firm*—Flynn, Thiel, Boutell & Tanis, P.C.

(57) ABSTRACT

For the manufacture of a ring part out of a flat sheet-metal part to form a lid for a lid of a can. A hot-sealable coating is provided on one side of the sheet-metal part which is then shaped into a cylindrical tube with the coating being on the inside. The axially extending edges of the tube are joined together to form a butt-joint and the inside surface thereof pressed against a cooling plate. A butt-joint welding seam is then created by means of a laser jet. The tube is separated into equal length tube sections and each is conically enlarged at one end. The other end of each tube section is bent radially inwardly to form a bearing surface for a tear-off foil. By flanging the conically enlarged end, an annular flange is created to receive a body of a can.

5 Claims, 6 Drawing Sheets

METHOD FOR THE MANUFACTURE OF A RING PART OUT OF SHEET METAL FOR A LID OF A CAN

FIELD OF THE INVENTION

The invention relates to a method for the manufacture of a ring part out of sheet metal for a lid of a can.

BACKGROUND OF THE INVENTION

Such a method is described, for example, in the DE 43 32 306 A1. A flat sheet-metal part, which has a hot-sealable coating on one side, is hereby shaped into a cylindrical tube, where the coating is on the outside of the tube. The axially extending edges of the tube are compressed and are welded together, which is done by means of a laser jet and results in the formation of a butt-joint welded seam. The tube is then separated into equal length tube sections or rather into body blanks. Each body blank is reshaped into a ring part, namely on the outside for the formation of an outer annular flange configured to receive the body of the can. A rolling is provided on the inside edge, the upper side of which rolling serves as a bearing surface for mounting of a tear-off foil. This bearing surface has the hot-sealable coating so that the tear-off foil can be sealed with this bearing surface.

This method has a number of disadvantages. The hot-sealable coating, which consists of an organic material, and which is provided on the outside of the tube, is destroyed during the laser welding. Combustion products of the coating get into the melt of the welding seam and cause a carbon accumulation in the welding seam, which in turn causes a hardening of the welding seam. The hardening of the seam is four to five times the hardness of the parent metal. The combustion of the coating takes place like an explosion, which causes holes to be created in the welding seam. In order to guarantee the sealing ability in the welding-seam area, it is necessary to repair the welding-seam area with a new coating. It is furthermore disadvantageous that the high hardness of the welding seam reduces the shaping ability and results in an increased wear of the shaping tools.

SUMMARY OF THE INVENTION

The purpose of this invention is to further develop the method so that with an easy shaping ability of the sheet-metal part a hot-sealably coated bearing surface for the tear-off foil is created.

BRIEF DESCRIPTION OF THE DRAWINGS

Exemplary embodiments will be discussed in greater detail hereinafter in connection with the drawings, in which.

DETAILED DESCRIPTION

Figure 1:
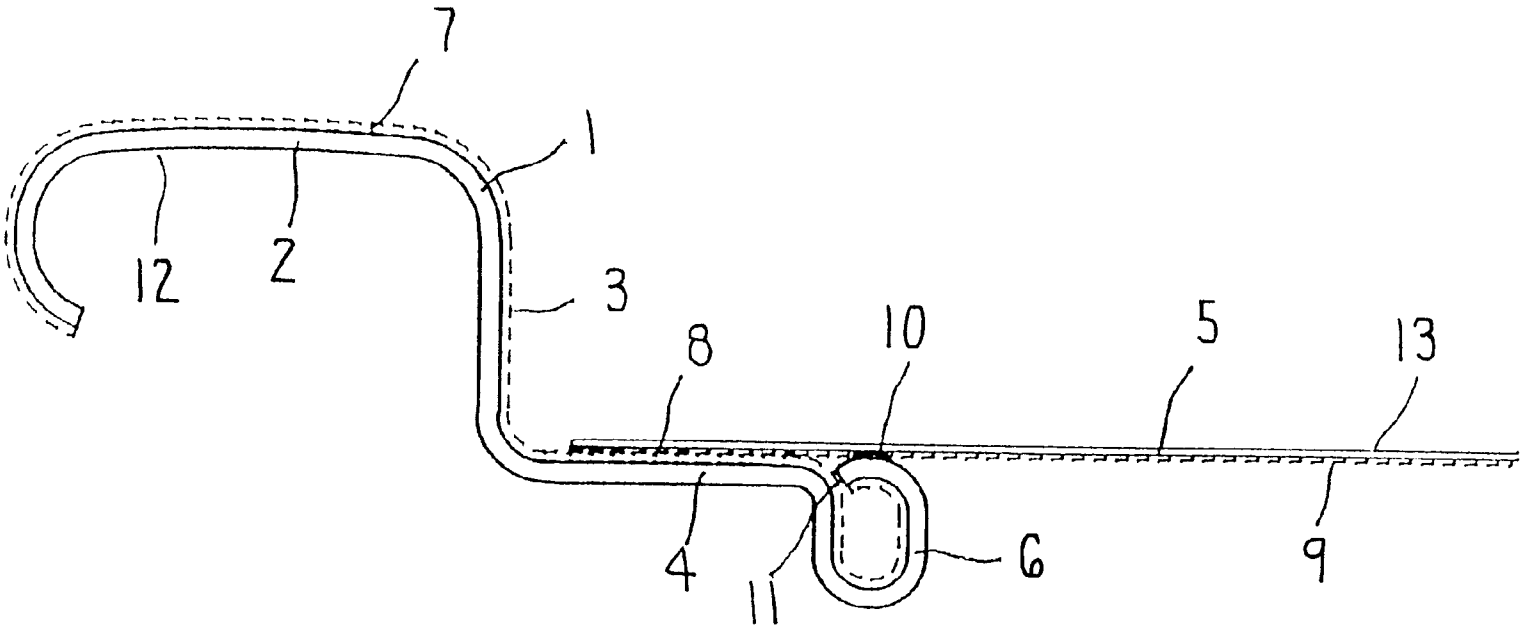
FIG. 1 is a cross-sectional view of an edge of a lid of a can.

FIG. 1 illustrates a ring part 1 having a radially outer annular flange 2 for receiving a not illustrated body of a can, an intermediate cylindrical section 3 and a radially inwardly extending ring surface serving as a bearing surface 4 for a tear-off foil 5. The radially inner edge of the bearing surface 4 terminates in an annular rolling 6. The inner edge section is rolled upwardly so that the upper surface of the rolling 6 is flush with the bearing surface 4.

The upper surface of the ring part 1 is coated with a hot-sealable coating 7. This coating is thus also provided on the upper surface of the bearing surface 4 and the inside surface of the rolling 6, thus achieving a flat hot sealing 8 with the tear-off foil 5. The underside of the tear-off foil 5 can also be coated with a hot-sealable coating 9, thus also achieving a hot sealing at 10 with the outside surface of the rolling 6 to shield the content of the can from the exposed end 11 of the rolling 6. The respective other side of the ring part 1 and of the tear-off foil 5 have a lacquered coating 12 or 13 in the form of a sealable lacquer.

Figure 2:
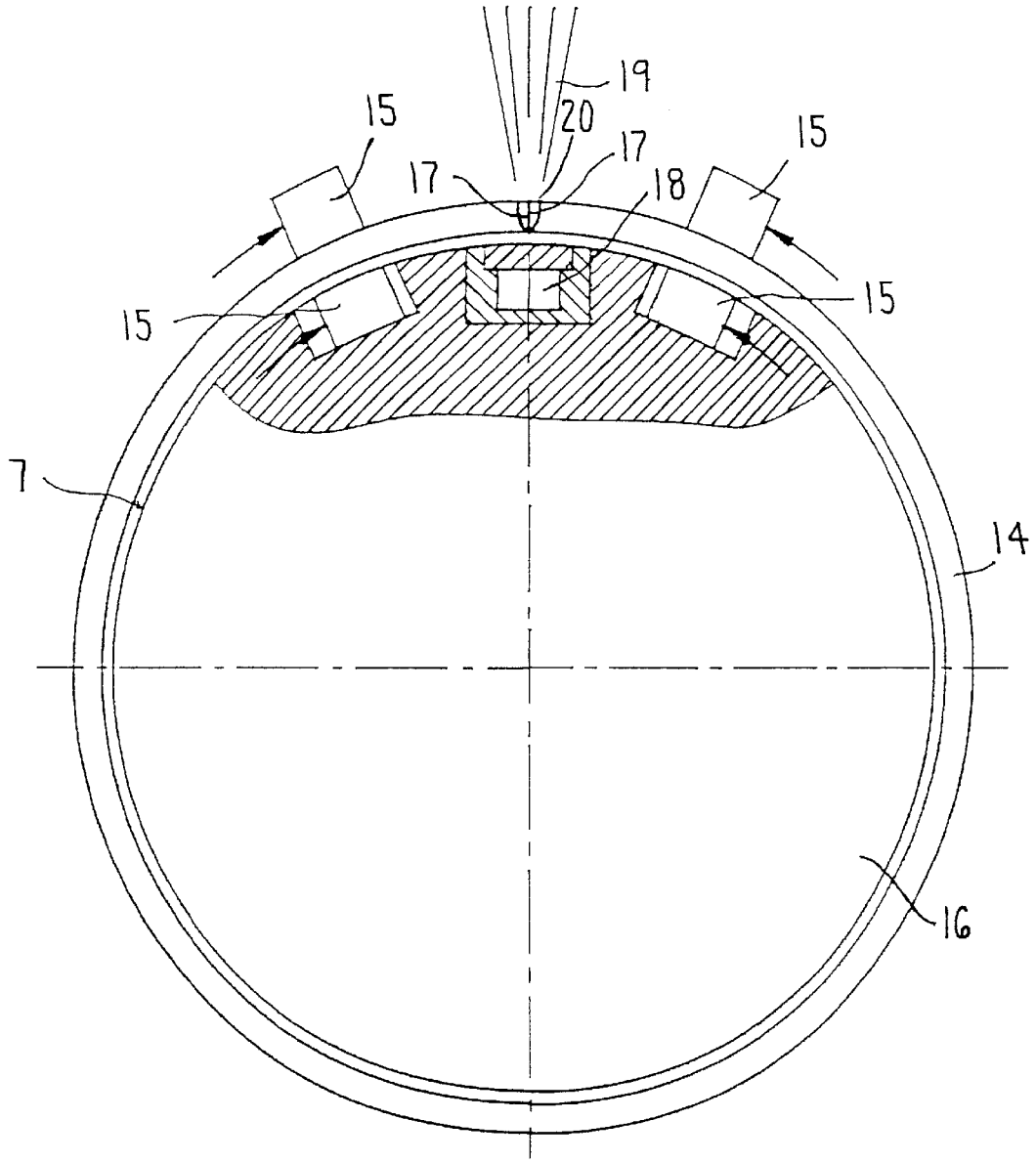
FIG. 2 illustrates the welding of a sheet-metal part.

In order to make the ring part 1, and according to FIG. 2, a flat sheet-metal part is first shaped into a cylindrical tube 14, whereby the flat sheet-metal part is pulled over a cylinder 16 by means of clamping jaws 15, thus causing the axially extending edges 17 to be pressed against one another. The hot-sealable coating 7 is hereby provided on the inside facing surface. The cylinder 16 has along the edges 17 a cooling plate 18, along which flows a cooling medium on the inside. The axially extending edges 17 are joined together by means of a laser jet 19. The cooling plate 18 prevents the coating 7 from being destroyed in the area of the joined together seam 20. By suitably controlling the laser jet 19 it can be achieved that the coating 7 melts in the area of the seam 20 so that the seam 20 is covered to become hermetically sealed on the inside face by the coating 7. The tube 14 is then separated into tube sections, as this is described in the DE 43 32 306 A1.

Figure 3:
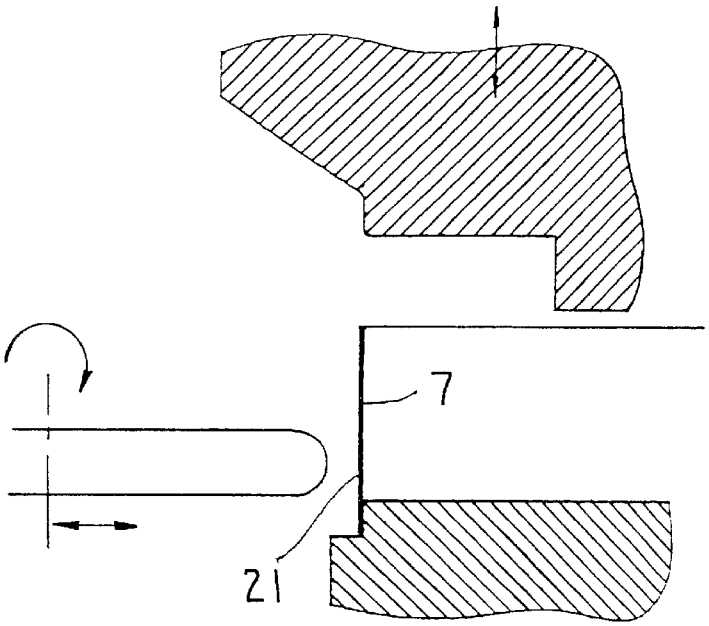
FIGS. 3 to 9 illustrate successive method steps for the manufacture of the ring part.
Figure 4:
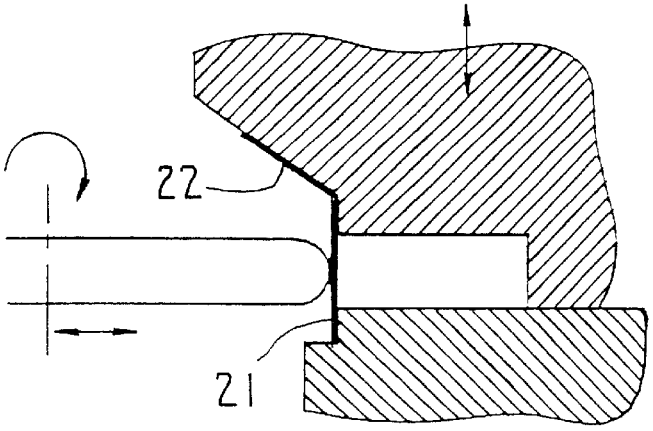
Figure 5:
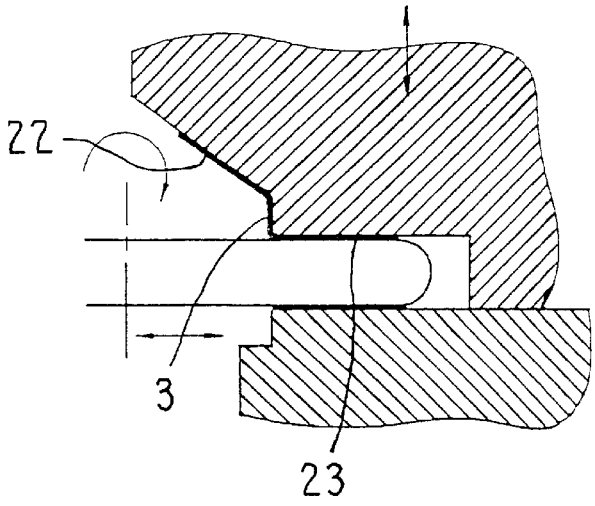
Figure 6:
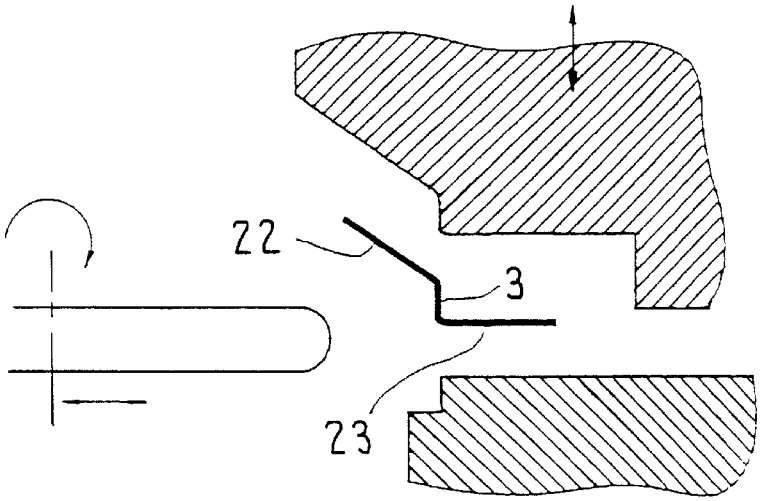

FIG. 3 illustrates a tube section 21 with the inside facing coating 7, which tube section is to be shaped into the ring part 1. According to FIG. 4, a conical enlargement 22 is formed at the top of the tube section 21. In the next step, according to FIG. 5, the lower end of the tube section 21 is bent radially inwardly, whereby the pulled-in section is identified by the reference numeral 23. The cylindrical section 3 therefore exists between the conical enlargement 22 and the section 23 as illustrated in FIG. 6.

Figure 7:
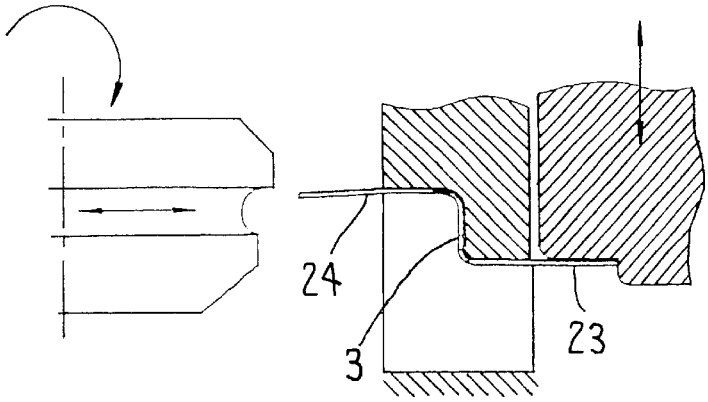
Figure 9:
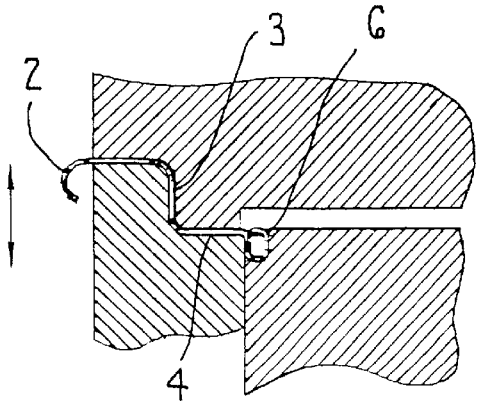

The conical enlargement 22 is, according to FIG. 7, further bent to form an annular flange 24, corresponding to the annular flange 2, and is configured to receive the body of the can. The radially inner edge section 23 is at the same time bent downwardly, thus forming the bearing surface 4. The inner edge is, according to FIG. 9, then rolled in upwardly and forms the rolling 6.

Figure 8:
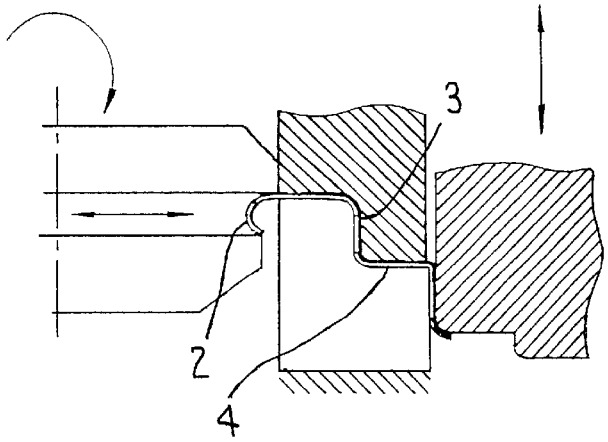
Figure 10:
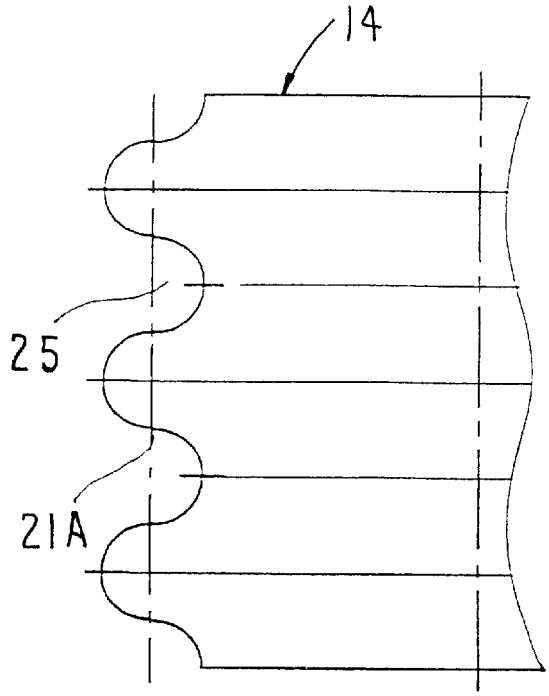
FIG. 10 illustrates a modified embodiment for the processing of a cylindrical tube.
Figure 11:
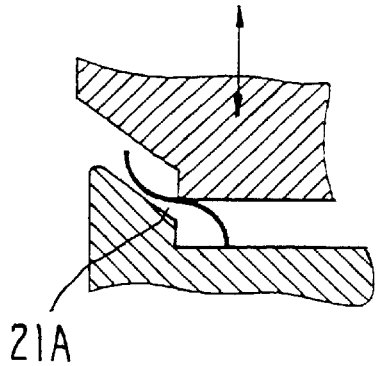
FIGS. 11 and 12 are method modifications of the method steps illustrated in FIGS. 3 to 6.
Figure 12:
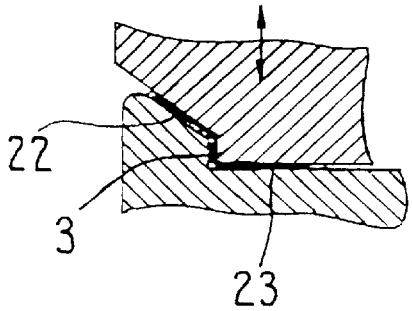

The cylindrical tube 14 has, according to FIG. 10, a sinuous exterior as at 25, with radially outwardly projecting beads and bead depressions therebetween, whereby the tube is subsequently separated into tube sections 21A each in the area of a projecting bead and a bead depression. According to FIGS. 11 and 12 the upper area of the tube section 21A is conically enlarged and the lower area is bent radially inwardly. The next following process steps correspond to FIGS. 7 to 9.

What is claimed is:

1. A method for the manufacture of a ring part out of sheet metal for a lid of a can comprising the following steps:

a) shaping of a flat sheet-metal part, which has a hot-sealable coating on one side, into a cylindrical tube, where the coating is on the inside facing surface, b) pressing the axially extending edges of the tube together to form a butt-joint and pressing a cooling plate against the inside of the tube along the axially extending edges, c) providing a butt-joint welding seam along the axially extending edges by means of a laser jet directed onto the outside of the edges, d) separating the tube into equal length tube sections, e) providing a conical enlargement at one end of each tube section, f) radial pulling in of the other end of each tube section to form a bearing surface for a tear-off foil, and g) flanging of the conically enlarged end to form an outer annular flange configured to receive a body of a can.

2. The method according to claim 1, wherein prior to separating the tube into tube sections beads are provided on the tube, the separation occurring along the bead depressions and along the bead elevations, and the area of the bead elevation of each tube section is conically enlarged.

3. The method according to claim 1, wherein between the conical enlargement of the one end and the radially inwardly shaped other end there remains a cylindrical section.

4. The method according to claim 1, wherein the section following on the inside of the bearing surface is bent downwardly and the bent section is rolled in upwardly.

5. The method according to claim 4, wherein the rolling in is done in a manner in which the uppermost surface of the rolling extends in a plane of the bearing surface.

* * * * *